US007418218B2

(12) United States Patent
Thayer

(10) Patent No.: US 7,418,218 B2
(45) Date of Patent: Aug. 26, 2008

(54) CONDUCTIVE BACKER BRUSH FOR ELECTROSTATIC BRUSH CLEANING OF A BELT WITHOUT A GROUND LAYER

(75) Inventor: Bruce E. Thayer, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 264 days.

(21) Appl. No.: 11/358,549

(22) Filed: Feb. 21, 2006

(65) Prior Publication Data

US 2007/0196124 A1 Aug. 23, 2007

(51) Int. Cl.
*G03G 15/16* (2006.01)

(52) U.S. Cl. ..... 399/101; 399/313; 399/314; 399/343; 399/353; 399/354

(58) Field of Classification Search ..... 399/313, 399/314, 101, 343, 353, 354
See application file for complete search history.

(56) References Cited

U.S. PATENT DOCUMENTS 4,279,496 A * 7/1981 Silverberg ..... 399/164
4,706,320 A * 11/1987 Swift ..... 399/354
6,070,043 A * 5/2000 Fujita et al. ..... 399/313
2005/0117932 A1* 6/2005 Takiguchi et al. ..... 399/101

FOREIGN PATENT DOCUMENTS

JP 09054503 A * 2/1997

* cited by examiner

*Primary Examiner*—David M. Gray
*Assistant Examiner*—Ryan D Walsh
(74) *Attorney, Agent, or Firm*—James J. Ralabate

(57) ABSTRACT

A transfer cleaning station for an electrostatic marking system is provided. In this station, the upper surface of a movable transfer belt is cleaned by a rotating electrostatic cleaning brush (ESB). To improve cleaning performance and conserve space, a grounded conductive brush is placed below an inside surface of the belt so that an electrostatic cleaning field is created between it and the ESB. The grounded conductive brush is located in a previously unused space between two upper rollers in the station.

1 Claim, 5 Drawing Sheets

CONDUCTIVE BACKER BRUSH FOR ELECTROSTATIC BRUSH CLEANING OF A BELT WITHOUT A GROUND LAYER

This invention relates to an electrostatic marking system and, more specifically, to transfer belts used in the toner transfer step.

BACKGROUND

Generally, in a commercial electrostatographic reproduction apparatus (such as copier/duplicators, printers, or the like), a latent image charge pattern is formed on a uniformly charged photoconductive or dielectric member. Pigmented marking particles (toner) are attracted to the latent image charge pattern to develop such image on the dielectric member. A receiver member, such as paper, is then brought into contact with the dielectric member and an electric field applied to transfer the marking particle developed image to the receiver member from the dielectric member. After transfer, the receiver member bearing the transferred image is transported away from the dielectric member and the image is fixed or fused to the receiver member by heat and/or pressure to form a permanent reproduction thereon.

It is a common practice with an image forming apparatus to use an image transferring device of the type electrostatically transferring a toner image formed on an image carrier, or photoconductive element, to a sheet carried on a transfer belt to which an electric field opposite in polarity to the toner image is applied, and a separating device for separating the sheet from the photoconductive element. The devices of the type described usually include an arrangement for applying a transfer bias to the transfer belt. For example, an electrode member is connected to a high-tension power source and held in contact with the rear of the belt at an image transfer position. Such an arrangement, or so-called contact type transfer and separation arrangement, is advantageous over one which relies on a corona charge since it does not produce harmful ozone and can operate with a low voltage.

Electrostatic brush (ESB) cleaners have successfully cleaned belt photoreceptors with a combination of mechanical and electrostatic forces. Electrostatic forces are generated when charged particles enter an electric field created between the biased brush fibers and the grounded conductive layer within, the photoreceptor belt. It is desired to clean other surfaces, such as transfer belts, that do not have a conductive layer that can be grounded. In order to clean such surfaces, the belt is typically wrapped around a conductive roller. The size of the roller and the amount of wrap must be such that the entire brush interference to the belt is located over the roller. This requirement for creation of the electric field results in space limitations due to large rollers and belt tracking issues if multiple brushes and backer rollers are needed.

Today, in electrostatic marking systems, the marking apparatus is often smaller and more compact. Any size reduction in components is desirable since less space is occupied in component crammed apparatuses. When transfer belts are used in lieu of corotron transfer means, large conductive grounded rollers upon which these belts travel have been used. These rollers, while necessary and efficient, take up a large amount of space and add significant cost to the system.

SUMMARY

This invention provides a system wherein a conductive backer brush is used for electrostatic brush cleaning of a belt without a ground layer. Electrostatic brush (ESB) cleaners have successfully cleaned photoreceptors with a combination of mechanical and electrostatic forces. Electrostatic forces are generated when charged particles enter an electric field between the biased brush fibers and the photoreceptor ground plane. In order to clean other surfaces, such as transfer belts that do not have a conductive layer that can be grounded, the belt is typically wrapped around a conductive roller. This requirement for creation of an electric field results in space constraints due to large rollers and belt tracking issues if multiple brushes and backing rollers are required. Grounded conductive brushes are provided as an alternative to conductive backer rollers for ESB cleaning of belts without an internal ground layer. Electrostatic cleaning fields are created between the biased ESB fibers and the grounded conductive fibers on the inside surface of the belt.

Heretofore electrostatic cleaning brushes (ESB) were positioned over a conductive grounded backer roller at a reference electrical potential. This is required in order to establish an electric field between the cleaning brush and the surface to be cleaned, like a transfer belt. The electric field provides the force that moves the charged particles to the brush fibers. The conductive surface is usually grounded but it could also be held at any electrical potential that creates a cleaning field between the brush and the belt to be cleaned. By placing the ESB above the grounded backer roller, significant space is occupied. In the present invention, conductive grounded brush backers are provided as an alternative to conductive backer rollers for electrostatic brush (ESB) cleaning of belts without an internal ground layer. Electrostatic cleaning fields are created between the biased ESB fibers on the outside surface of the belt and the grounded conductive brush fibers on the inside surface of the belt. The fiber material, denier, pile height, weave density and interference to the belt can be chosen to provide the desired amount of backing force. The backing brush may provide a limited amount of cleaning on the inside of the belt. Accumulation of dirt on the backing brush will not be detrimental to its function as an electrical ground. A conductive grounded brush is placed in unoccupied space below the cleaning rotating brush (ESB) allowing the transfer belt to move between this grounded brush and the rotating cleaning brush. This conductive brush provides wider ESB contact (than a conductive roller) with the transfer belt. In addition, the conductive brush uses a small amount of space (heretofore unused) inside the transfer belt. The conductive belt does not complicate belt tracking. Belt tracking is the motion control necessary to maintain a stable position of the belt as it passes over the rollers. Poor belt tracking allows the belt to "walk" toward one end of the rollers or to oscillate between positions. Very poor belt tracking can result in a catastrophic condition where the belt moves off the end of the rollers. Tracking of the belt over the rollers becomes more difficult when the number of rotating supports (e.g., rollers) in the system is increased. Passive belt tracking systems use crowned rollers and/or edge guides. Active belt tracking systems use belt position sensing and moveable rollers to steer the belt to a desired position.

DETAILED DISCUSSION OF DRAWINGS AND PREFERRED EMBODIMENTS

Figure 1:
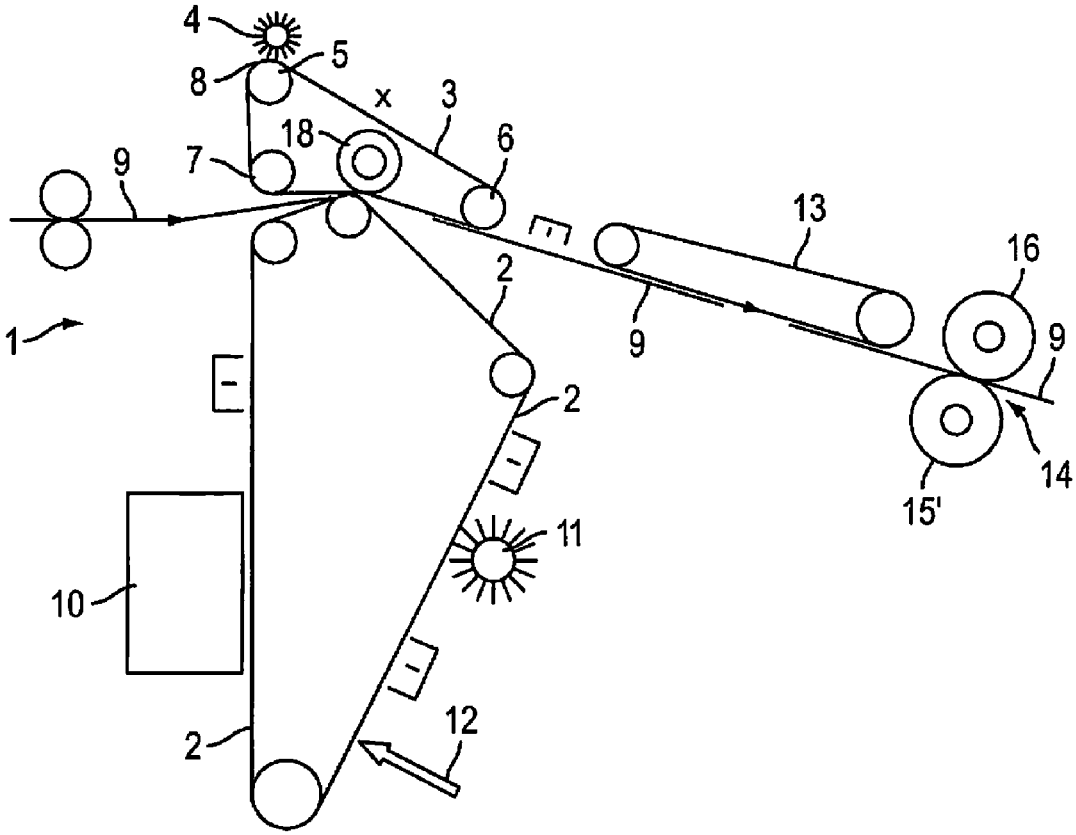
FIG. 1 PRIOR ART
FIG. 1 illustrates a complete typical marking system used in the prior art.

In FIG. 1, a complete electrostatic marking system 1 is illustrated having a photoconductive belt 2, a transfer belt 3, a transfer belt cleaning brush 4, transfer belt rollers 5, 6 and 7 upon which the transfer belt 3 travels. The transfer belt cleaner brush (ESB) 4 is positioned over conductive grounded roller 5 where transfer belt 3 passes via a slight gap or space 8 for the transfer belt to move therebetween. A paper or paper path 9 is designated where the paper is transported between transfer belt 3 and photoconductor belt 2. A developer housing 10, a photoconductor cleaning brush 11 and exposure station 12 are shown. A pre-fuser transport belt 13 is depicted as it provides means for transport of the paper 9 to the fuser station 14. Fuser station 14 is made up of a fuser roll 15 and a pressure roll 16.

Figure 3:
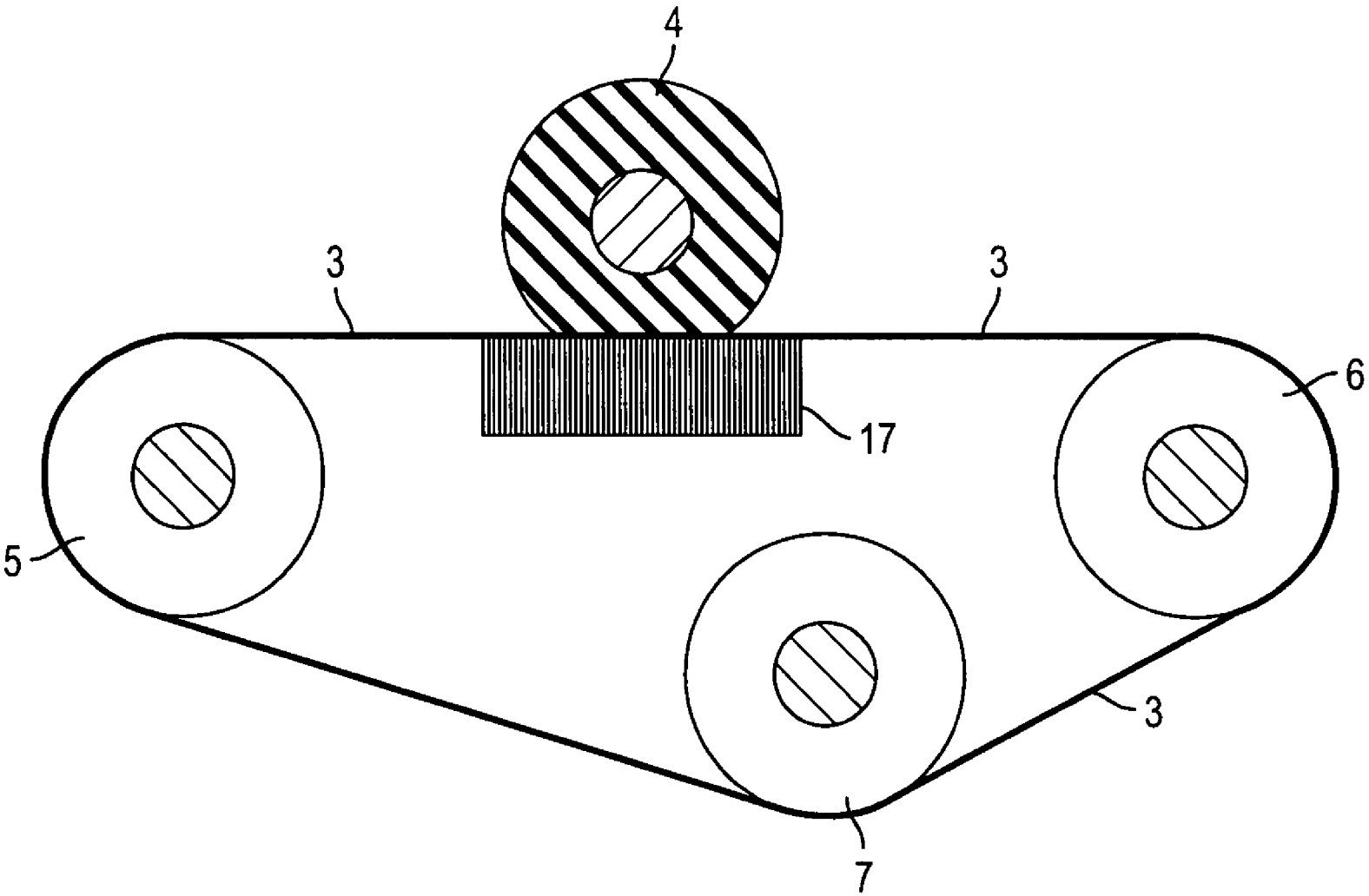
FIG. 3 illustrates a transfer belt embodiment of the present invention using a conductive grounded brush.
Figure 5:
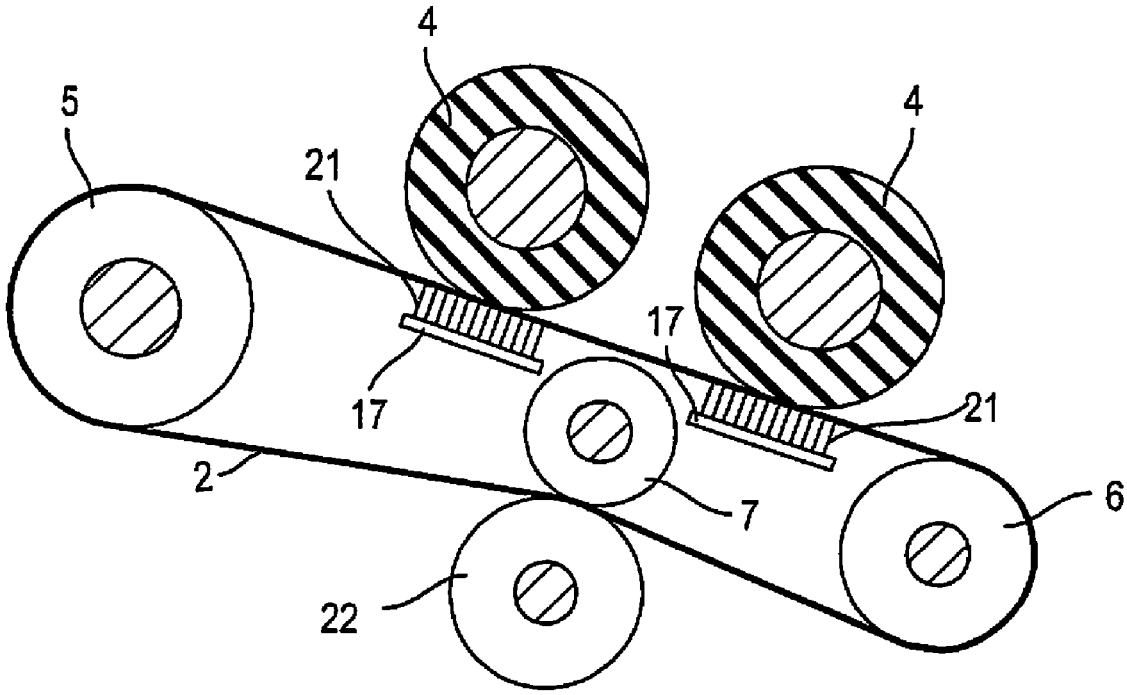
FIG. 5 illustrates an embodiment of the present invention where the transfer belt system comprises two ESB and two conductive backer brushes.

In the present invention, the transfer belt cleaning brush ESB 4 is moved (from the position shown in FIG. 1) to a point over belt 3 about midway between rollers 5 and 6 and the conductive grounded brush 17 of this invention is moved under belt 3 opposite to cleaning brush 4 in its new position. The new positions of ESB and conductive grounded brush 17 are indicated in FIG. 1 by an X; and as shown in FIGS. 3 and 5. As above noted, due to space constraints in the present invention, the cleaner brush 4 is moved to the right on the transfer belt 3 span between rollers 5 and 6 at the X location. It may also be desirable to add a second ESB 4 which further increases the space problems over the prior art location over roller 5. The conductive grounded back brush(s) 17 enables movement of the brushes 4 and 17 to the right where space is not an issue. A transfer belt system cleaning station replaces corotron and bias transfer roll systems. The function of a transfer belt system is the same as the other systems; to transfer charged toner particles from the photoreceptor surface 2 to the document media 9 (e.g. paper). The roller 18 inside the transfer belt is a bias transfer roll (BTR). The BTR 18 and belt 3 are pressed against the photoreceptor 2 (p/r belt in this case). The BTR 18 is biased to supply the transfer electrical field that moves the toner image from the photoreceptor surface 2 to the paper 9. The transfer belt 3 provides a wider zone of mechanical contact forces pressing the paper 9 down onto the photoreceptor 2. By using mechanical pressure, the paper 9 is flattened. This enables better transfer and elimination of deletions on non-flat papers (air gaps between the paper and the photoreceptor in the transfer nip are reduced). The electrical resistivity of the transfer belt 3 is important. A typical range of resistivities is $10^8$ to $10^{12}$ ohm-cm. The belts 3 are typically made of polymeric or elastomeric materials, e.g., NBR (natural butyl rubber), poly imide. The belt 3 may have one or more overcoat layers (e.g., polyurethane). One function of these layers can be to provide a surface that is more easily cleaned. Unlike a photoreceptor belt 2, there is no conductive layer within the belt 3 that can be grounded.

The cleaner 4 removes primarily toner and paper debris from the transfer belt 3. Since the belt 3 is pressed against the back of the paper 9 that the toner is being transferred to, paper fibers, fillers and other debris accumulate on the belt 3. The transfer belt 3 can also collect other debris from the photoreceptor surface 2 when the paper 9 is not in the transfer nip. The debris accumulated on the transfer belt must be removed to prevent several problems:

1. Dirt on the back of prints—the dirt of concern is primarily toner. If it is not cleaned from the transfer belt 3, then it will eventually transfer to the back of the paper sheet 9 as it passes through transfer. In duplex operation, the dirt will show on the printed sides as well.

2. Poor transfer—If the debris level builds up sufficiently, the effective electrical resistivity of the transfer belt 3 will increase. The increased resistivity of the belt 3 will reduce the transfer fields and result in poor transfer performance. Since the debris typically does not build up uniformly on the transfer belt 3, poor transfer defects will typically be obvious as density variations in half-tone areas.

3. Increase in machine dirt—If not cleaned, debris on the transfer belt 3 will eventually build up to the point where no more material can be adhered. At this point, the debris will begin shedding from the transfer belt 3. The debris can fall onto the paper path 9 and create print deletions. The debris can accumulate on the inside of the transfer belt 3 and cause belt slip by reducing friction between the belt and drive roller 7. Debris can reduce the reliability of other machine elements such as drive components and charge devices.

Figure 2:
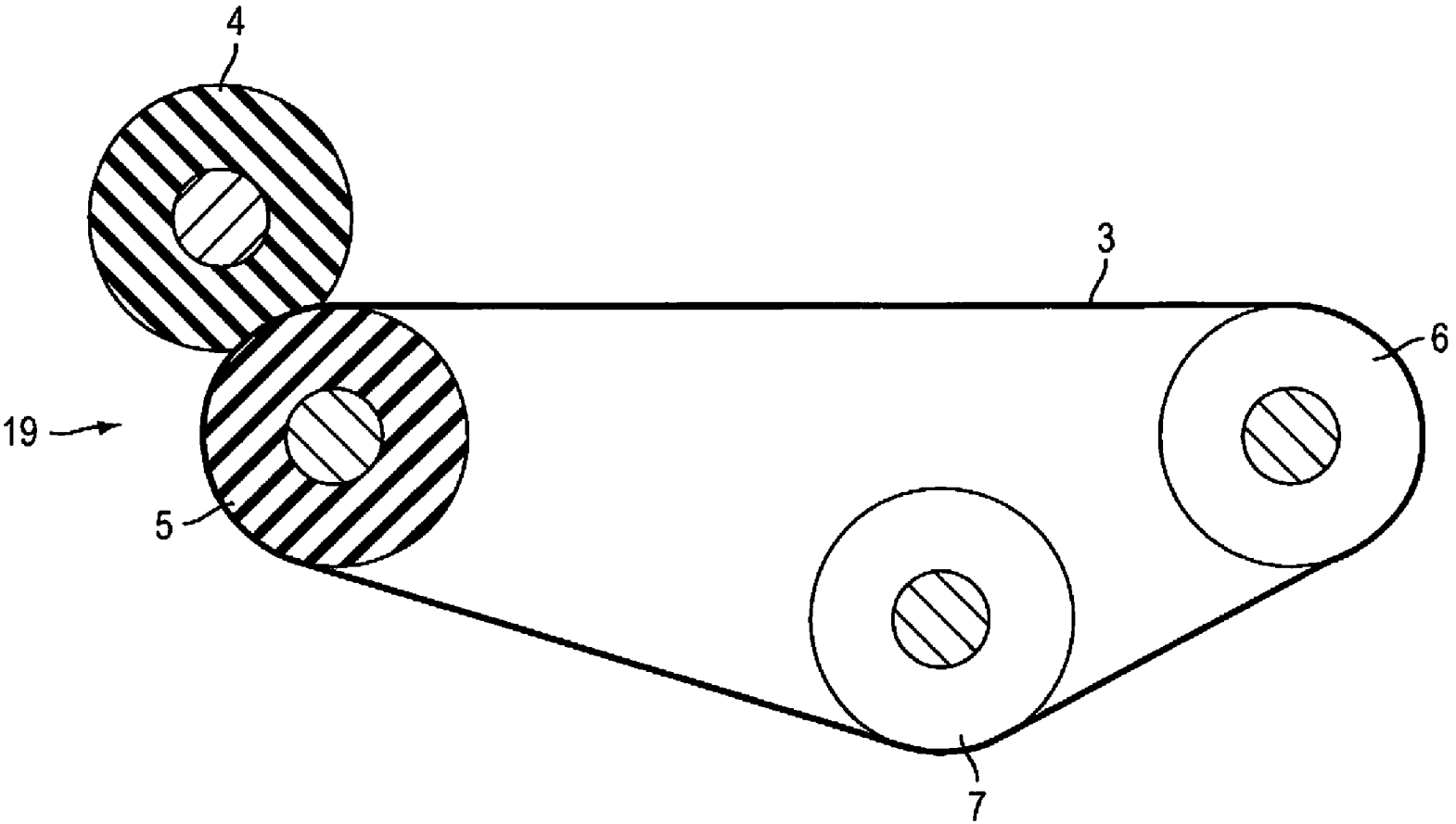
FIG. 2 PRIOR ART
FIG. 2 illustrates a transfer belt structure used in the prior art.

In FIG. 2, a prior art transfer belt 19 system is shown having a transfer belt cleaning brush (ESB) 4 positioned over grounded roller 5. The ESB must be positioned over conductive roller 5 at a reference electrical potential. This is required in order to establish an electric field between the cleaning brush 4 and the transfer belt 3 to be cleaned. The electric field provides the force that moves the charged particles to the brush 4 fibers. This system 19 shown in FIG. 2 corresponds to the transfer belt station or arrangement shown in FIG. 1 except for the relocation of cleaner brushes 4 and backer brushes 17 to location X.

FIG. 3 illustrates a transfer cleaning station embodiment of the present invention where conductive grounded brush 17 and cleaning brush (ESB) 4 are both relocated between rollers 5 and 6 (at location X shown in FIG. 1). The weave density of grounded brush 17 needs to be sufficient to provide an adequate electrical ground (or reference voltage) for good electrostatic cleaning of belt 3. The advantages of using a conductive brush 17 include: A. providing a wider ESB contact than the conductive roller, thus better cleaning; B. uses a smaller amount of space inside belt not taking up additional space; C. does not complicate belt tracking and D. backer brush 17 is relatively inexpensive. While FIG. 3 illustrates a one cleaner brush 4 system, two or more cleaner brushes 4 and backer brushes 17 may be used, if suitable.

Figure 4A:
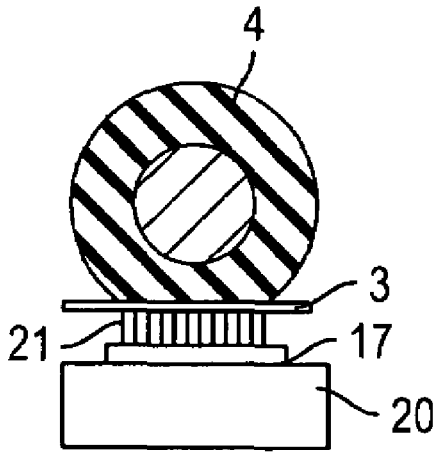
FIG. 4A illustrates a front view, and FIG. 4B a side view of an embodiment of the present conductive backer brush as it contacts the transfer belt in a one brush system
Figure 4B:
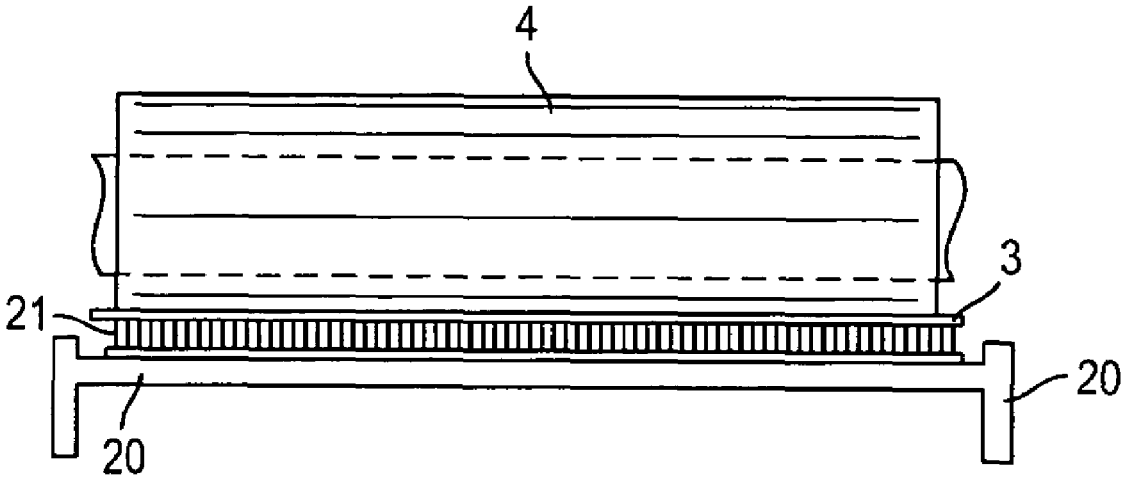

In FIGS. 4A and 4B, an embodiment of the cleaning brush system of this invention is shown. In both the front view and side view of 4A and 4B, respectively, a cleaning brush ESB 4 is illustrated at a position above grounded backer brush 17. Transfer belt 3 passes between ESB 4 and back brush 17 during the cleaning operation where debris and toner are removed from transfer belt 3. The backer brush 17 has a backer support that can be made from any suitable material as may be the fibers 21. While the present cleaning system or station is described in relationship to a transfer belt and system, it may be used in the cleaning of any belts without an internal ground layer. Both a front and side view of the brush cleaning system in the transfer cleaning station are shown in FIG. 4. Conductive backer brushes 17 can be made of the same or similar conductive fiber material that is used to make any other ESB cleaner brushes. These materials include carbon coated nylon, e.g., BASF and Shakespeare solution coated nylon, carbon loaded acrylic, e.g. Toray SA-7, extruded carbon loaded segments, e.g. Beltron, and others. Conductive fibers 21 are typically woven into a backing fabric. The fabric is then back coated with a conductive material to prevent fibers 21 from being pulled from the fabric and to provide an electrical conduction path to all fibers. The pile fabric is then mounted to a support surface 20 parallel to the belt. The support surface 20 is spaced from the belt 3 at a distance to enable the desired amount of brush to belt interference. Brush to belt interference would typically range from 1 to 3 mm.

Electrical connections from ground to the backer brush 17 could be made in a number of ways. Contact could be made directly to the brush fibers 21 on an end or side of the brush. The conductive back coating on the brush pile fabric would then provide an electrical path to the entire brush. Contact could be made to the conductive back coating 20. This could be through conductive mounting adhesive to a grounded support or contact to a wire or clip. The brush fabric 21 may be mounted in a crimped metal strip similar to "weather stripping" style brush seals.

The normal force that the brush 17 applies to the inside surface of the belt 3 can be designed to a desired value. If the cleaning brushes 14 are located in the center of a wide span between belt support rollers 5 and 6, then the backer brush 17 could be designed to provide significant mechanical support to the belt. If the cleaning brush 4 is located between two closely spaced belt support rollers, then low brush forces against the belt may be desirable to minimize belt drag and wear. Many brush design parameters (fiber material, fiber denier, pile height, weave density, brush to belt interference) are available to tune the brush normal force. Factors to consider when determining the desired brush normal force include the following: support of the belt under the ESB cleaning brush 4; wear of the inside surface of the belt 3; filming of the inside surface of the belt 3; cleaning of the inside surface of the belt 3; drag forces on the belt 3; deflection of the belt 3; brush fiber 21 set over time and brush pile height and brush 17 to belt 3 interference tolerances.

Brush weave density needs to be sufficient to provide an adequate electrical ground (or reference voltage) for good electrostatic cleaning. Too sparse a brush would result in the ESB 4 not achieving its full cleaning capacity. Weave densities higher than typically used in cleaning brushes are not required for a good ESB backer brush. Higher interferences will help because higher brush to belt interferences pack the fiber tips closer together.

In FIG. 5, an embodiment of a cleaning brush system or station similar to that of FIGS. 4A and 4B is illustrated, except in FIG. 5 two cleaning brushes 4 and two conductive backer brushes 17 are used. Both of these brushes 4 and 17 are positioned as in FIGS. 4A and 4B between rollers 5 and 6. All other aspects of the one brush system of FIG. 4 apply equally as well to the embodiment of FIG. 5. Roller 22 is used to direct the photoconductor belt 2 against transfer belt roller 7.

Embodiments of this invention include a transfer cleaning station useful in an electrostatic marking system. This station comprises in an operative arrangement, a movable non-conductive transfer belt movable around at least three rollers. Included is at least one rotating electrostatic biased cleaning brush (ESB) and at least one grounded conductive brush. The ESB is positioned above an outside surface of the transfer belt. The grounded conductive brush is positioned below an inside surface of the transfer belt. The ESB and the grounded conductive brush are located at substantially the same belt location above and below the transfer belt thereby leaving a space for passage of the belt therebetween. The ESB and grounded conductive brush are to create an electrostatic cleaning field between the biased ESB on the outside surface of the belt and the grounded conductive brush on the inside surface of the belt.

In this station a first of at least three rollers is closest to a photoconductive surface and a second and third of the three rollers are located further from the photoconductive surface. The ESB and the grounded conductive brush are positioned relative to the belt at a location between the second and third rollers. The ESB is enabled to contact and clean the outside surface of the transfer belt. Either one or two or more ESBs and grounded conductive brushes may be used in the present invention.

In the station, a fiber material, denier, pile height, weave density and interference to the belt on either or both the ESB and the grounded conductive brush are pre-selected for optimum cleaning of the belt. The grounded conductive brush is used whereby its weave density is sufficient to provide an adequate ground for optimum electrostatic cleaning by said ESB.

In summary, this invention provides a transfer-cleaning station useful in an electrostatic marking system comprising in an operative arrangement a movable non-conductive transfer belt, at least three rollers in contact with the belt, at least one electrostatic rotating electrostatic biased cleaning brush (ESB) and at least one grounded conductive brush. The ESB is positioned above an outside surface of the transfer belt and is enabled to contact and clean the outside surface. The grounded conductive brush is positioned below an inside surface of the transfer belt and is enabled to contact the inside surface. The ESB is located above the grounded conductive brush and is enabled to provide thereby an electrostatic cleaning field between fibers of the biased ESB and fibers of the grounded conductive brush. The ESB and the grounded conductive brush are located between at least two of the rollers that are located farthest from a photoconductive surface than are other of the rollers in the station. The ESB is rotating in an opposite direction than the movement of the transfer belt.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A transfer-cleaning station useful in an electrostatic marking system comprising in an operative arrangement:

a movable transfer belt, at least three rollers in contact with said belt, at least one electrostatic rotating electrostatic biased cleaning brush (ESB), and at least one grounded conductive brush, said ESB positioned above an outside surface of said transfer belt and enabled to contact and clean said outside surface, said grounded conductive brush positioned below an inside surface of said transfer belt and enabled to contact said inside surface, said ESB located above said grounded conductive brush and enabled to provide thereby an electrostatic cleaning field between fibers of said biased ESB and fibers of said grounded conductive brush, said ESB and said grounded conductive brush located between at least two of said rollers (5) and (6) that are located farthest from a photoconductive surface than are the other (7) of said rollers in said station, said ESB rotating in an opposite direction than the movement of said transfer belt, said grounded conductive brush comprising conductive fibers woven into a backing fabric, said fabric coated with a conductive material to provide thereby an electrical conduction path to all said fibers, said backing fabric being mounted to a support surface that is parallel to said transfer belt, said support surface spaced from said belt at a distance to enable a desired amount of said grounded brush to belt interference, said interference being in the range from 1 to 3 mm.

* * * * *